US010285458B2

(12) United States Patent
Mazzarolo

(10) Patent No.: US 10,285,458 B2
(45) Date of Patent: May 14, 2019

(54) GARMENT FOR MOTORCYCLISTS PROVIDED WITH A LENGTH ADJUSTMENT DEVICE

(75) Inventor: Giovanni Mazzarolo, Coste di Maser (IT)

(73) Assignee: ALPINESTARS RESEARCH SRL, Coste di Maser (Treviso) (IT)

( * ) Notice: Subject to any disclaimer, the term of this patent is extended or adjusted under 35 U.S.C. 154(b) by 0 days.

(21) Appl. No.: 14/236,439

(22) PCT Filed: Aug. 3, 2012

(86) PCT No.: PCT/IB2012/053978
§ 371 (c)(1),
(2), (4) Date: Jan. 31, 2014

(87) PCT Pub. No.: WO2013/018065
PCT Pub. Date: Feb. 7, 2013

(65) Prior Publication Data

US 2014/0173813 A1 Jun. 26, 2014

(30) Foreign Application Priority Data

Aug. 3, 2011 (IT) ..... TV2011A0113

(51) Int. Cl.
*A41D 13/00* (2006.01)
*A41D 1/08* (2018.01)
(Continued)

(52) U.S. Cl.
CPC ..... *A41D 13/0002* (2013.01); *A41D 1/08* (2013.01); *A41D 13/065* (2013.01);
(Continued)

(58) Field of Classification Search
CPC ..... A41D 31/0077; A41D 31/02; A41D 3/00; A41D 7/00; A41D 11/00; A41D 13/00;
(Continued)

(56) References Cited

U.S. PATENT DOCUMENTS 2,355,193 A * 8/1944 Walker ..... A41D 1/067 2/227
4,117,552 A * 10/1978 Simpson ..... 2/2.14
(Continued)

FOREIGN PATENT DOCUMENTS

DE 202004012222 U1 10/2004
FR 2862494 A1 5/2005
(Continued)

OTHER PUBLICATIONS

PCT International Search Report and Written Opinion dated Nov. 7, 2012 for PCT/IB2012/053978, from which the instant application is based, 7 pgs.

*Primary Examiner* — Clinton T Ostrup
*Assistant Examiner* — Catherine M Ferreira
(74) *Attorney, Agent, or Firm* — Fredrikson & Byron, P.A.

(57) ABSTRACT

A garment for motorcyclists which includes a pair of trousers, a belt portion, at least one adjusting insert and at least one protective element which is removably applied to the knee portion of the garment. Said at least one protective element is removably housed in a pocket arranged in the garment. The garment is also provided at the bottom portion of said pair of trousers with fixing means suitable for defining a plurality of height positions with reference to the belt portion of the garment. Said at least one adjusting insert is suitable for being removably fixed to the fixing means in order to adjust the length of the trousers. The garment is also provided at its knee portion with fastening means suitable for defining a plurality of height positions with reference to the belt portion of the garment. Said fastening means are suitable for adjusting the configuration of the pocket in which the protective element is housed in order to adjust the positioning of said protective element.

20 Claims, 6 Drawing Sheets

(51) Int. Cl.
*A41D 13/06* (2006.01)
*A41D 15/00* (2006.01)
*A41D 13/05* (2006.01)

(52) U.S. Cl.
CPC ..... *A41D 15/002* (2013.01); *A41D 13/0575* (2013.01); *A41D 2600/102* (2013.01)

(58) Field of Classification Search
CPC ..... A41D 13/002; A41D 13/0025; A41D 13/012; A41D 13/0153; A41D 13/0155; A41D 13/0543; A41D 13/0568; A41D 13/065; A41D 13/08; A41D 13/01; A41D 13/02; A41D 13/001; A41D 2600/102; A41D 27/28; A41D 13/0002; A41D 13/015; A41D 13/018; A41D 13/0007; A41D 13/008; A41D 13/05; A41D 13/1209; A41D 13/1218; A41D 31/0016; A41D 31/0061; A41D 13/0005; A41D 2400/52; A41D 13/0015; A41D 13/0012; A41D 13/0525; A41D 1/002; A41D 1/04; A41D 13/0512; A41D 1/084; A41D 2400/20; A41D 2600/10; A41D 31/0055; A41D 1/08
USPC ..... 2/456, 455, 22, 23, 62, 79, 227
See application file for complete search history.

(56) References Cited

U.S. PATENT DOCUMENTS

| | | | | | |
|---|---|---|---|---|---|
| 4,183,099 | A * | 1/1980 | Lacey | 2/24 | |
| 4,200,938 | A * | 5/1980 | LeTourneau | 2/269 | |
| 4,920,577 | A * | 5/1990 | Scharf | A41D 1/067 | 2/22 |
| 4,985,936 | A * | 1/1991 | Jones | 2/269 | |
| 5,611,081 | A * | 3/1997 | Torres | A41D 13/0593 | 2/227 |
| 6,108,819 | A * | 8/2000 | DeBaene et al. | 2/227 | |
| 6,751,804 | B1 * | 6/2004 | Warner et al. | 2/23 | |
| 7,216,370 | B1 * | 5/2007 | Warner | A41D 13/0575 | 2/23 |
| 8,307,465 | B2 * | 11/2012 | French et al. | 2/250 | |
| 8,656,514 | B2 * | 2/2014 | Neuron | 2/23 | |
| 2003/0150042 | A1 * | 8/2003 | Leflet et al. | 2/23 | |
| 2007/0169250 | A1 * | 7/2007 | Maniguet | A41D 1/08 | 2/227 |
| 2009/0282600 | A1 * | 11/2009 | Robinson | A41D 27/20 | 2/79 |
| 2012/0005797 | A1 * | 1/2012 | Cotsoglou et al. | 2/16 | |

FOREIGN PATENT DOCUMENTS

| | | | | |
|---|---|---|---|---|
| WO | 2010071937 A1 | | 7/2010 | |
| WO | WO2010071937 | * | 8/2010 | A41D 13/00 |

* cited by examiner

GARMENT FOR MOTORCYCLISTS PROVIDED WITH A LENGTH ADJUSTMENT DEVICE

RELATED APPLICATIONS

This application is a 35 U.S.C. 371 national stage filing from International Application No. PCT/IB2012/053978 filed Aug. 3, 2012 and claims priority to Italian Application No. TV2011A000113 filed Aug. 3, 2011, the teachings of which are incorporated herein by reference.

FIELD OF THE INVENTION

The present invention relates to a garment for motorcyclists provided with a length adjustment device.

BACKGROUND

As it is well known, the garments which are usually worn by racing drivers or motor-cycling amateurs are usually provided with protective elements in the form of padding and/or rigid (or semi rigid) shields suitable for minimizing the impacts occurring in case of a fall or accident.

Such protective elements, which are typically applied in zones corresponding to the articulations of the user's body, such as elbows, shoulders and knees, are usually fastened on the external layer of the garment or between the outer layer and the lining of the garment.

In this latter case, the protective elements are generally fastened in a well known manner to the internal side of the outer layer of the garment or inside proper pockets.

From one side, it is important that the protective elements do not hinder the movements of the motorcyclist, from the other side it is essential that the protective elements remain stably in their positions, in correspondence with those parts of the body to be protected.

In order to not reduce the effectiveness of such protective elements it is also required that the garment as whole fits properly over the user's body, not having areas too tight or too loose over the user's body (for not annoying the wearer or not affecting the aerodynamic features of the garment) and having a proper size and length (for not leaving uncovered any body portion and thus offering an inadequate protection against climate conditions like wind, rain, etc.).

In this connection it should be noted that, even if the manufacturers of the motorcyclist garments offer to the potential customers clothing having various sizes and variants, it is almost impossible that any garment fits properly any zone of the body.

This is due not only to the fact that the various zones of wearer's body, in particular the limbs, are extremely variable in shape, but also to the fact that the garments should be worn by customers having different age and build.

With reference, for example, to the trousers designed to be worn by motorcyclists, in order to guarantee a high level of safety and a correct wearability of the trousers, it is required that the trousers have a proper length and assure a correct positioning above the knees of the related protective elements.

Often, the customers can find a pair of trousers having a proper length but in which, once the trousers are worn, the knee protective elements do not match perfectly with the body articulation to be protected, being applied in a position higher or lower than required.

Alternatively, a customer can find a pair of trousers having the knee protective elements which, once the trousers are worn, fit properly the body area to be protected, but in which the trousers are longer or shorter than required.

Both such occurrences reduce the safety offered by the trousers since in the first case, in the event of a fall, the protection offered by the knee protective elements could be ineffective. In the second case, the wearer could be hindered in his movements by the excessive length of the trousers or some of his body portions could remain unprotected against the climate conditions.

Moreover, in some particular cases, it can also be required that one single garment is worn by different users having a different build, for example, when, in emergency circumstances, the owner of the garment lends his garment to an another motorcyclist. Also in this occurrence, it is almost impossible that the garment fits properly the body of the wearer, without annoying him in any manner.

The object of the present invention is therefore to provide a garment which solves at least partially the above mentioned problems and drawbacks.

BRIEF SUMMARY OF EMBODIMENTS OF THE INVENTION

In particular, an aim of the present invention is to provide a garment for motorcyclists comprising a pair of trousers provided with a length adjustment device, so that the trousers can be easily adapted to the size and shape of the wearer allowing at the same time to adjust the positioning of the knee protective elements.

BRIEF DESCRIPTIONS OF DRAWINGS

These and other objects and aims are achieved by the garment according to claim 1.

The advantages and the characteristic features of the invention will emerge more clearly from the following description of a preferred, but not exclusive, embodiment of the garment, which refers to the accompanying figures in which.

DETAILED DESCRIPTION OF EMBODIMENTS OF THE INVENTION

In the following description of the garment according to the invention, as "bottom" there will be indicated the part or component of the garment which, during the normal use, is relatively closer to the ground and as "top" the part or component relatively farther.

Similarly, as "internal" there will be indicated the part or component of the garment which, during the normal use, is relatively closer to the user's body and as "external" the part or component relatively farther.

Figure 1:
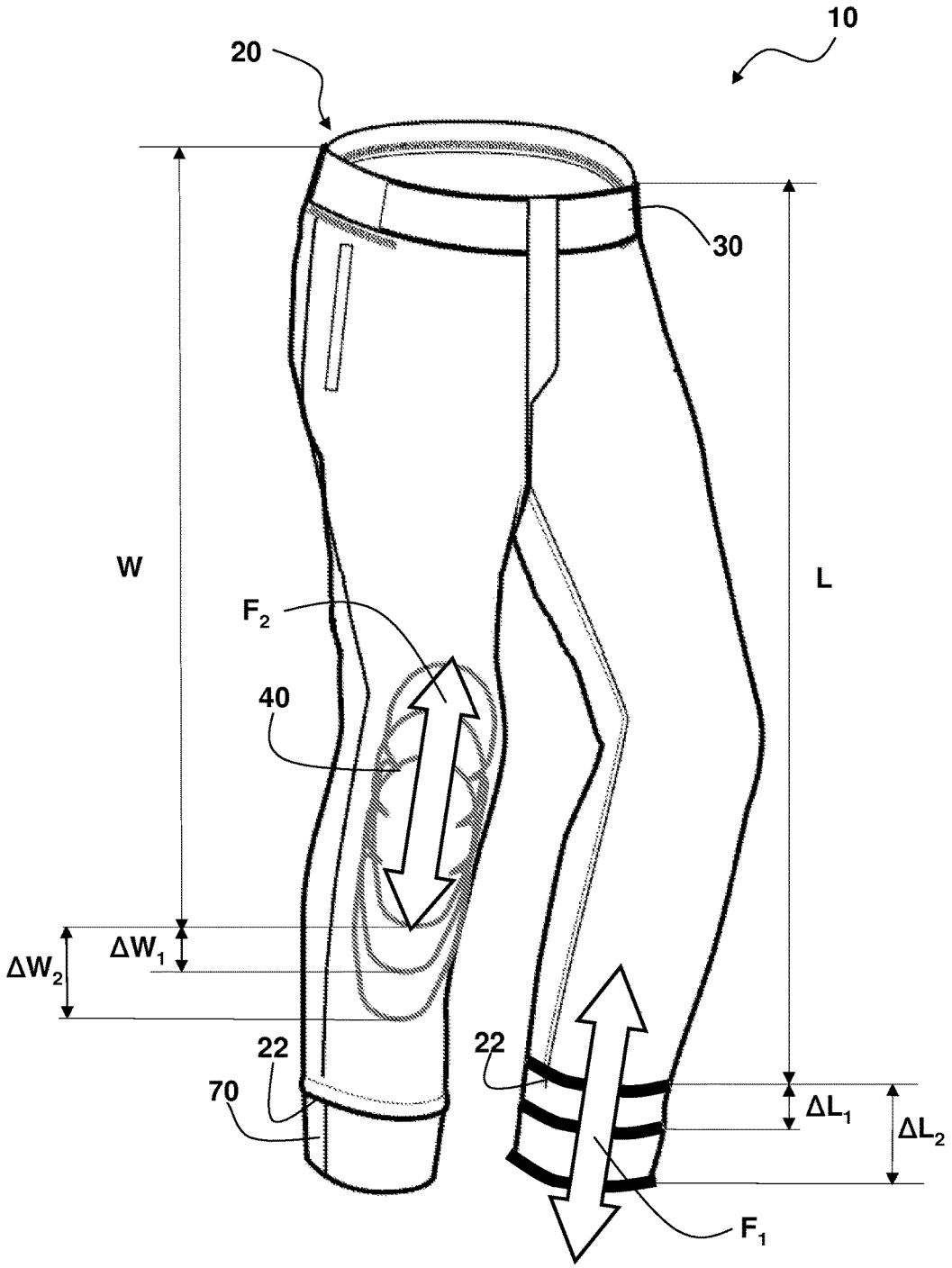
FIG. 1 shows a simplified perspective view of a garment according to the invention.

With reference first of all to FIG. 1, the present invention refers to a garment 10 for motorcyclists. Said garment 10 comprises a pair of trousers 20 which is provided with a belt portion 30. This belt portion 30, when the garment is worn by the user, is suitable for encompassing the waist of the user.

In the following description the top edge of the belt portion 30 of the garment 10 will be used as reference level for defining the height positions of some components or part of the garment 10 of the present invention.

In detail, as "height position" there will be indicated the distance between a reference level and an axis, positioned parallel to the ground and running through the centre of a part or component of the garment, so as to give an approximation of the location of said part or component of the garment.

For sake of clarity the top edge of the belt portion will be identified as "belt line" of the garment.

The garment 10 is preferably made of leather or synthetic textile or waterproof fabric, so as to offer an adequate protection against weather conditions. In a well known manner the garment 10 can also be provided with elastic inserts (not shown in the attached figures) suitable for favouring the position assumed by the body of the user when riding motorcycle, without limiting the freedom of movement of the wearer when he is not riding the motorcycle.

For sake of clarity, the following description and the related figures will be referred, in a not exclusive way, to a garment 10 which solely comprises a pair of trousers 20.

Nevertheless, it will be obvious for a skilled man in the art to realize that the garment 10 of the present invention can also comprise, for example, in addition to said pair of trousers 20, a jacket or a vest (not shown in the attached figures).

In a similar way the garment 10 of the present invention can also be embodied in a bodysuit (namely a top combined with a pair of trousers 20 so as to form a single garment 10).

With reference to FIG. 1, the garment 10 comprises at least one protective element 40 which is removably applied to the knee portion of the garment 10.

In FIGS. 1-4, for sake of clarity, only one protective element 40 is shown (precisely, the protective element 40 applied on the right leg of the trousers 20). However, it should be noted that generally at least one protective element 40 is applied to the knee portion of each leg of the trousers 20.

Preferably said protective elements 40 are made of rigid or semi-rigid polymeric material or foam material or padding material.

These protective elements 40 have preferably an elongated shape so as to be suitable for protecting against knocks and impacts not only the kneecap of the knee, but also the area immediately above and below thereof. Moreover, said protective elements can be anatomically shaped for enhancing comfort and protection.

Each protective element 40 is housed in a seat 50 arranged in the garment 10 (see FIGS. 5-7 and FIGS. 11-13). In the present invention, as "seat" there will be indicated a portion of the garment 10 suitable for supporting and for keeping in a proper position the protective elements 40 applied to the garment 10.

Figure 13:
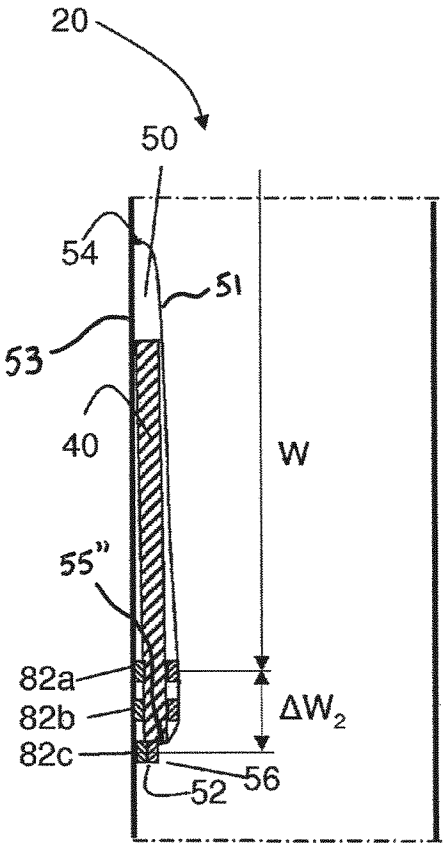
FIG. 13 shows a simplified cross sectional view of the knee portion of the garment according to plane XIII-XIII of FIG. 7.
Figure 12:
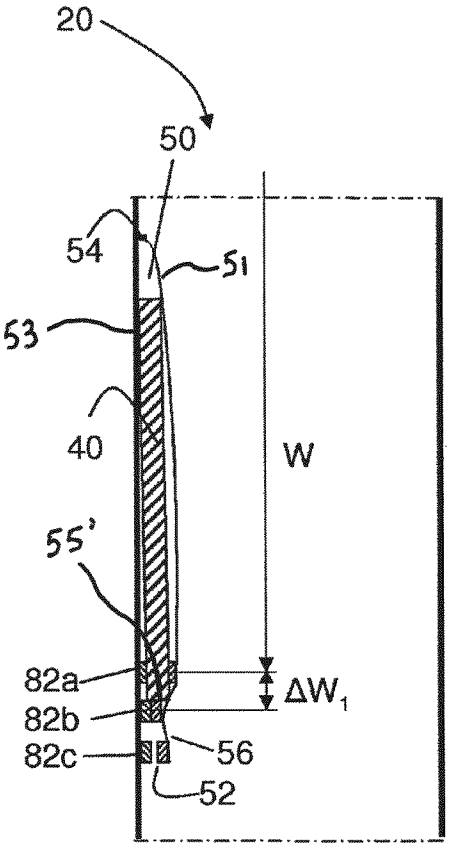
FIG. 12 shows a simplified cross sectional view of the knee portion of the garment according to plane XII-XII of FIG. 6.
Figure 11:
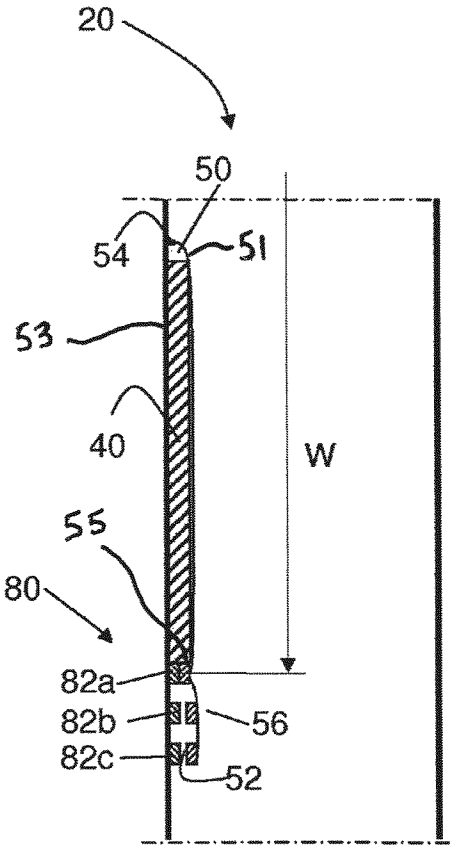
FIG. 11 shows a simplified cross sectional view of the knee portion of the garment according to plane XI-XI of FIG. 5.

Preferably, and as shown in FIGS. 11-13, each protective element 40 is applied in a seat 50 arranged in the interior on an internal layer of the garment 10. As further shown, the seat 50 is defined between a flap 51 and an interior surface 53 of a leg of the trousers 20. Nevertheless, it can be easily envisaged the provision of proper seats 50 for housing the protective elements 40 also on the external layer of the garment 10.

If the garment 10 is provided with an internal lining (not shown in the attached figures), the internal layer of the garment will be the internal layer of the lining. As above mentioned, each seat 50 is configured to secure the protective element 40 to the knee portion of the garment 10. Generally each leg of the trousers 20 of the garment 10 is provided with at least one seat 50.

The seat 50 is configured as a pocket having an opening 52 through which the protective element 40 can pass so as to be inserted in the seat 50.

Figure 7:
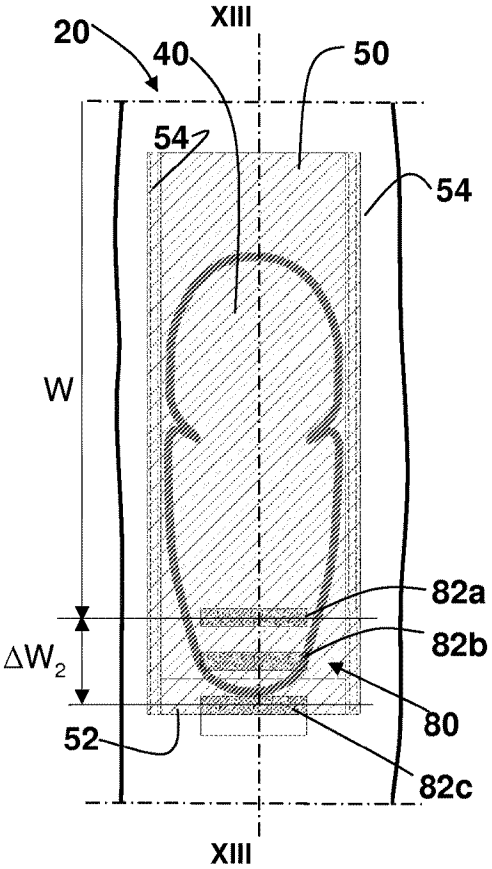
FIGS. 5-7 are three simplified internal views of the knee portion of the garment of FIG. 1, showing three possible adjustments of a protective element according to the invention.
Figure 6:
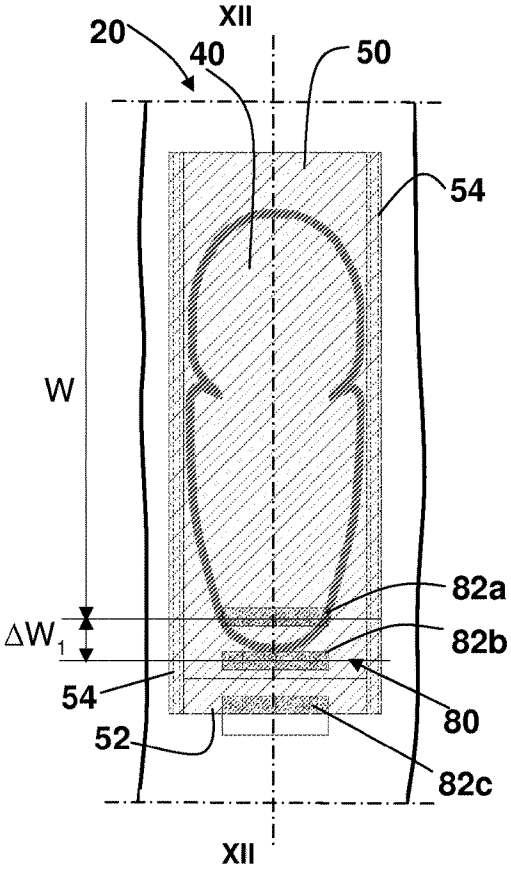
Figure 5:
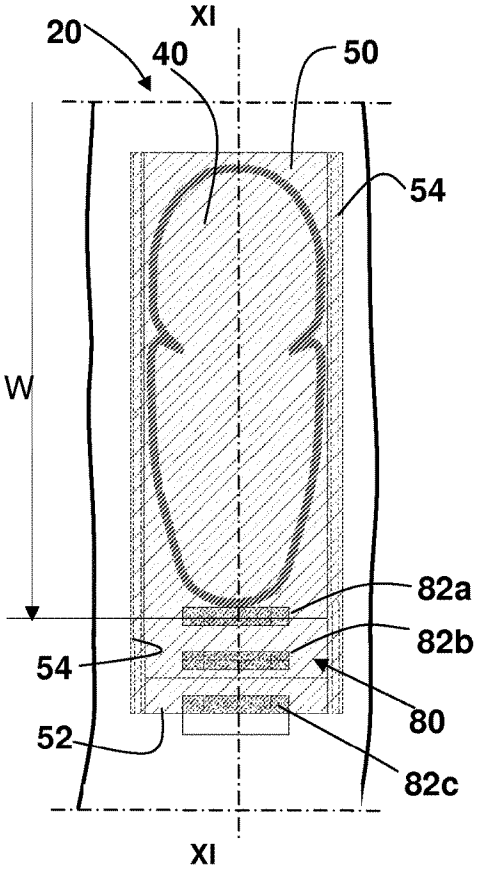

As shown in FIGS. 5-7, the opening 52 is preferably arranged on the bottom side of the seat or pocket 50.

The outer rims of the pocket 50, except for the opening 52, can be firmly attached to the internal layer of the garment 10 by means of stitching 54 or any other similar means (see FIGS. 5-7). According to an alternative embodiment of the invention, the outer rims of the pocket 50, except for the opening 52, can be removably connected to the internal layer of the garment 10 by means of hook-and-loop elements or any other similar means.

Similar considerations as regards the means for firmly or removably connecting the seats 50 to the garment 10 are still valid in case the seats 50 and the protective elements 40 are applied on the outer layer of the garment 10.

Figure 10:
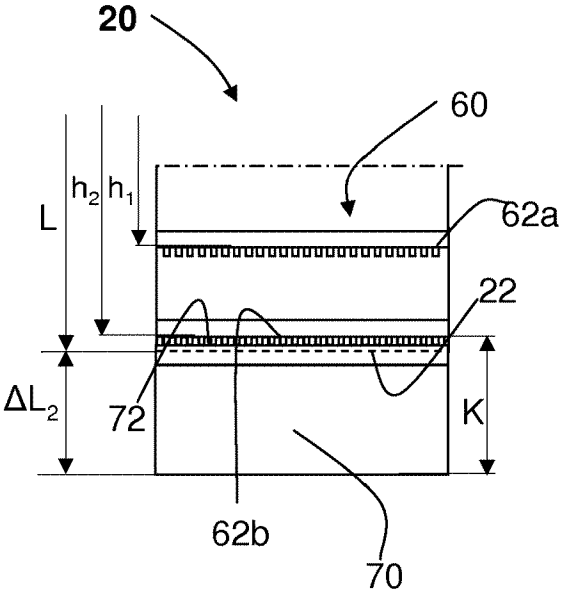
FIG. 8-10 are three simplified internal views of the bottom portion of the garment of FIG. 1, showing three possible adjustments of an adjusting insert of the garment according to the invention.
Figure 9:
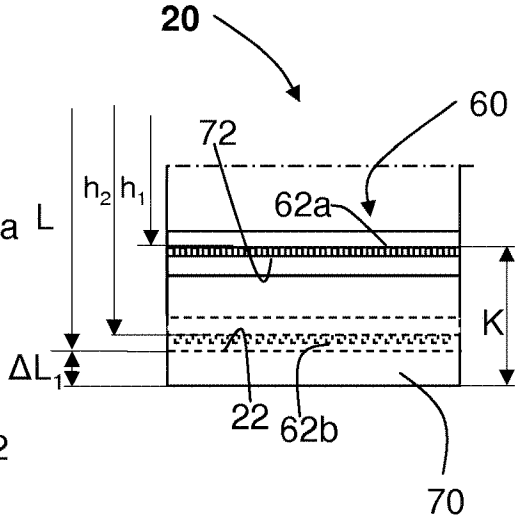
Figure 8:
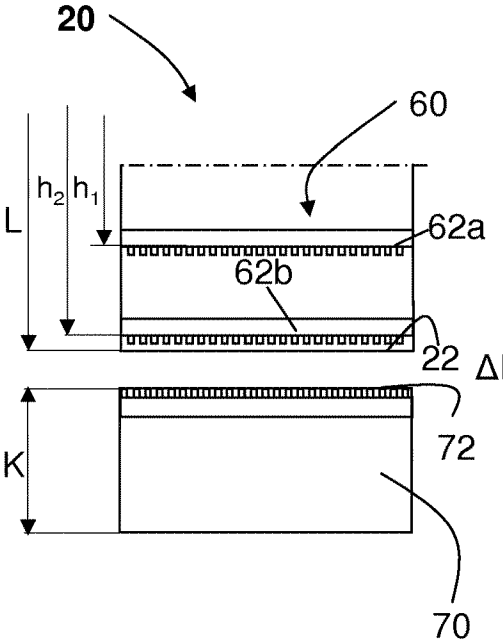

With reference to the FIGS. 8-10, the garment 10 further comprises fixing means 60 which are provided at the bottom portion of the trousers 20.

Said fixing means 60 are suitable for defining a plurality of height positions with reference to the belt line of the garment 10.

Said fixing means 60 could advantageously be zip fasteners or hook-and-loop fasteners, for example Velcro® type.

According to an alternative embodiment of the present invention, said fixing means 60 could be snap fasteners or any other similar means.

As it will be described in great detail in the following, said fixing means 60 are suitable for cooperating with corresponding fixing means 72 provided along the top edge of an adjusting insert 70.

In FIGS. 8-10, it is schematically illustrated the embodiment of the present invention in which the fixing means 60 of the trousers 20 and the fixing means 72 of the adjusting insert 70 are the two halves of a zip fasteners.

For a proper functioning of the invention, it is only required that the fixing means 72 of the adjusting insert 70 are of the same type of the fixing means 60 of the trousers 20 so as to make possible the junction between the trousers 20 and the adjusting insert 70. Therefore, in view of the above comments, the fixing means 72 of the adjusting insert 70 can be hook-and-loop fasteners or snap fasteners or any other similar means.

In this connection, it should be underlined that if the fixing means 60 and the fixing means 72 are zip fasteners, each of the fixing means 60 comprises only one half of a zip fastener, the other half of the zip fastener being provided on the corresponding fixing means 72.

Similarly, if the fixing means 60 and the fixing means 72 are hook-and-loop fasteners, the fixing means 62 comprises a strip of hook (or loop) material, the cooperating strip of loop (or hook) material being provided on the fixing means 72.

The same applies in case fixing means 60 and fixing means 72 are snap fasteners.

Preferably, fixing means 60 are provided on the internal layer of the garment 10.

Nevertheless, according to an alternative embodiment, such fixing means can also be provided on the outer layer of the garment 10.

The fixing means 60 comprise a plurality of fixing elements (see for example the fixing elements referenced by 62*a* and 62*b* in FIGS. 8-10) provided at different height position with reference to the belt line of the garment.

If the fixing means 60 consist of zip fasteners, it should be noted that the zip fasteners 62*a*, 62*b* are the half of a zip fastener and are spaced from each other by a distance which is preferably uniform. In detail, each half of the zip fastener 60 runs along the internal perimeter of leg of the trousers 20 so as to define a junction line between the trousers 20 and the adjusting insert 70, the junction line having a substantially loop shape.

In the preferred embodiment, the fixing means 60 comprise two halves of the zip fasteners 62*a*, 62*b* which are positioned at a distance of $h_1$ and $h_2$, respectively, from the belt line of the garment 10 (see FIGS. 8-10).

Nevertheless, it could be easily envisaged the provision of more than two halves of zip fasteners in order to allow the user, as it will be described in detail in the following, a large range of adjustments of the trousers length.

According to the invention, as it has been anticipated, the garment 10 further comprises at least one adjusting insert 70 suitable for being removably fixed to the fixing means 60 of the garment 10. As a matter of fact, such adjusting insert 70 can be detached from the garment 10 (see FIGS. 2 and 8).

Said adjusting insert 70 can be considered as an appendix of the garment 10 suitable for being removably fixed to the bottom portion of the trousers 20 for adjusting, if needed, the length of the trousers 20.

In the preferred embodiment of the invention, the garment 10 is provided with at least two adjusting inserts 70 (one for each leg of the trousers). Said adjusting inserts 70 are suitable for being removably fixed to the fixing means 60 provided on each leg of the trousers 20 so that the user is able to adjust the length L of each leg of the trousers 20 according to his own needs.

Figure 14:
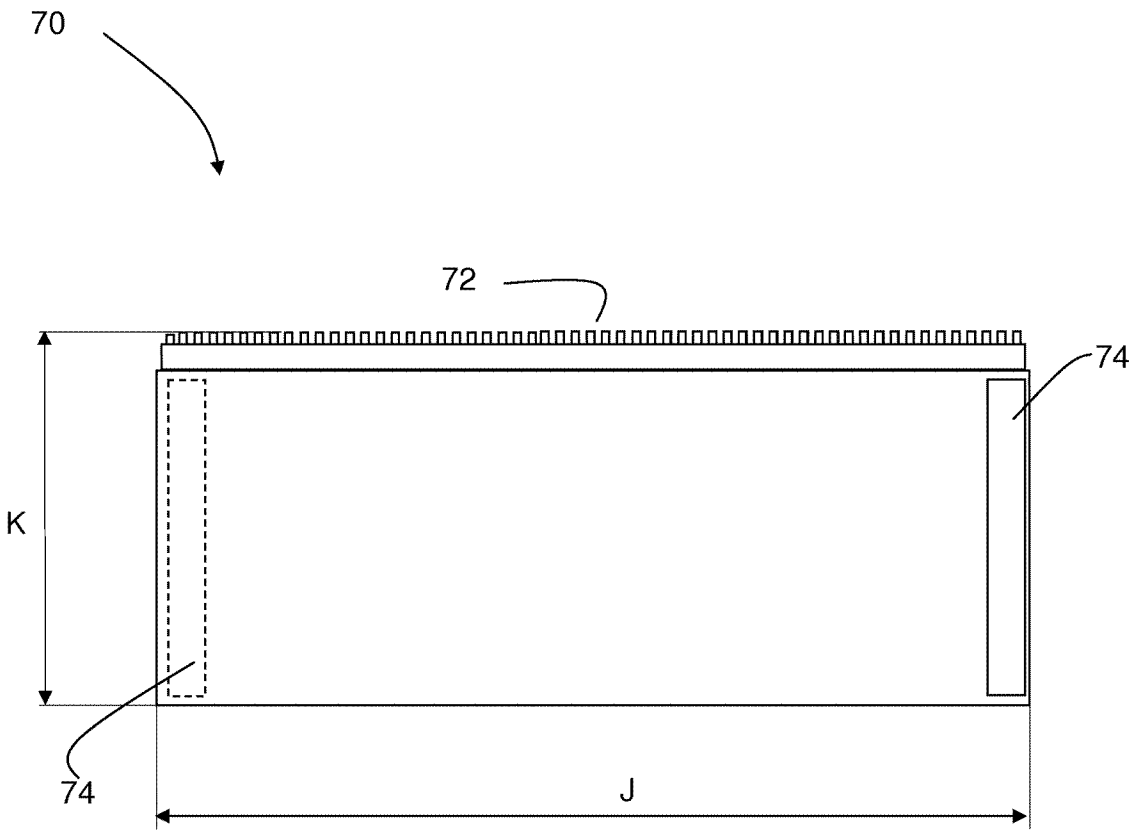
FIG. 14 shows a simplified view of the adjusting insert of the garment according to the invention in a flattened configuration.

Preferably, each adjusting insert 70 is shaped as a rectangular flexible panel having height K and length J; the length J of each adjusting insert 70 substantially coinciding with the bottom perimeter of the leg of the trousers 20 (see FIG. 14).

Alternatively, the flexible adjusting insert 70 can have a tubular shape having a circular cross-section. In this case, the diameter of the tubular adjusting insert 70 substantially coincides with the diameter of the bottom portion of the trousers leg.

Along the top edge of each adjusting insert 70, as anticipated, fixing means 72 are provided, suitable for cooperating with the fixing means 60 of the trousers 20.

In case the fastening means 72 are zip fasteners, on the top edge of the adjusting insert will be provided a first half of a zip fastener, the second half being provided on the corresponding fixing elements 62*a*, 62*b* of the fixing means 60.

The adjusting insert 70 is preferably made of the same material of the trousers 20.

Nevertheless the insert 70 can also be made of different materials and colours of those used for the garment 10, by combining in this way to a technical function, also an aesthetical solution.

For helping the adjusting insert 70 to conform itself to the shape of the bottom edge of the trousers 20, once that the adjusting insert has been fixed to the fixing means 60 of the trousers 20, the adjusting insert 70 can also be provided along its side edges with closing means 74 (see FIG. 14). Such closing means 74 are suitable for cooperating with each other in order to guarantee that the adjusting insert 70, after having been fixed to trousers 20, maintains a substantially ring shape, not having its side edges wide apart.

In case the adjusting insert has a tubular shape, the provision of the closing means 74 is not needed.

According to the invention, the garment 10 further comprises fastening means 80 provided at the knee portion of the garment 10. Such fastening means 80 are suitable for defining, in a similar way to what it is done by the fixing means 60 of the garment 10, a plurality of height positions with reference to the belt portion 30 of the garment 10.

Said fastening means 80 in their turn allow the user to adjust the configuration of the seats 50 in which the protective elements 40 are housed. In this way the user can also adjust, concurrently with the length of the trousers 20 (such first adjustment is illustrated by the arrow $F_1$ in FIG. 1), the height position of the protective elements 40 (such second adjustment is illustrated by the arrow $F_2$ in FIG. 1).

With reference to FIGS. 5-7 and 11-13, the fastening means 80 are arranged in correspondence of the seats 50 housing the protective elements 40.

Preferably, the fastening means 80 comprise a plurality of spaced-apart fastening members or a plurality of individual spaced-apart fastening member pairings, as perhaps best shown in FIGS. 11-13 as 82*a*, 82*b*, and 82*c*.

In the garment 10 according to the invention, in which the protective elements 40 are housed in pockets 50 arranged on the internal layer of the garment 10 (within and accessible only from an interior of the garment, as shown by FIGS. 11-13), the fastening means 80 comprise at least three fastening members 82*a*, 82*b*, 82*c* which are provided in proximity of the opening 52 of each pocket 50 (see FIGS. 5-7 and 11-13).

As shown in FIGS. 5-7, the fastening members 82*a*, 82*b*, 82*c* are positioned at different height positions W, $W+\Delta W_1$, $W+\Delta W_2$ with reference to the belt line of the garment 10.

The fastening members 82*a*, 82*b*, 82*c* can be hook-and-loop fasteners or snap fasteners or zip fasteners or any other similar means.

The function of the pairings of fastening members 82*a*, 82*b*, 82*c* is to close at different height positions W, W+ΔW1, W+ΔW2 two adjacent edges 56 of the opening 52 of the pocket 50, once the protective element 40 has been positioned inside the pocket 50 (see FIGS. 11-13), which as shown correspondingly defines a floor 55, 55', 55" for the pocket 50.

In this way the escape of the protective element 40 from the pocket 50 is prevented. At the same time, since the fastening members are positioned at different height positions W, $W+\Delta W_1$, $W+\Delta W_2$, the opening 52 of the pocket 50 is suitable for being closed at different height positions. In this way, the movement freedom of the protective element 40 in the pocket 50 will be reduced or increased, causing an adjustment of the positioning of the protective element 40 itself on the knee portion of the garment.

As a matter of fact, it should be noted that during the normal use of the garment 10, the trousers 20 are substantially perpendicular to the ground. As a consequence, the protective element 40, when the trousers 20 are worn by the user, is pushed down by its weight force so as to get in contact with the adjacent edges 56 of the opening 52 which are closed by one of the fastener members 82*a*, 82*b*, 82*c*.

Therefore, by acting on the fastening means 80 of the garment 10 the user can adjust the configuration of the seats 50 in which the protective elements 40 are housed. Such adjustment in configuration, as shown in FIGS. 5-7 and 11-13, involves an adjustment in pocket size, via change in pocket height. To that end, and with continued reference to FIGS. 5-7 and 11-13, such adjustment in configuration involves an adjustment in pocket depth.

In an alternative embodiment (not shown in the attached figures), wherein each protective element 40 is housed in a seat 50 arranged in the internal layer of the garment 10, the fastening means 80 of the garment 10 can directly be connected to corresponding fastening means provided on the outer surface of the protective elements 40, for example by arranging a plurality of strips of hook (or loop) material at different height positions on the internal layer of the garment and corresponding strips of loop (or hook) material on the outer surface of the protective element 40.

In this way, after being set the correct positioning of the protective element 40, the user can fasten it to the knee portion of the garment 10 by pushing the protective element 40 against the fastening means 80 of the garment. The cooperation between the strips of hook-and-loop material provided on the seat and on the protective element will make firm the connection between the protective element 40 and its seat 50.

Thanks to the provision of fastening means 80 on the knee portion of the garment, the user can get around a non proper positioning of the protective elements 40 caused by the trousers length adjustment previously carried out. At the same time, even if the length of the trousers do not need to be adjusted, the user has the possibility to adjust, according to his own needs, the positioning of the protective elements 40 above the body portion to be protected.

An alternative embodiment of the garment of the present invention (not shown in the attached figures) envisages, in case the garment comprises a vest or a jacket or it is embodied in a bodysuit, the provision of second fixing means at the wrist portion of the garment.

Said second fixing means are suitable for cooperating with corresponding fixing means provided on an additional adjusting insert of the garment, so as to make possible, in a similar way to what it has been illustrated, the adjusting of the length of the sleeves of the garment.

Moreover, in order to adjust the positioning of the protective elements applied to the elbow portion of the garment, the garment can also be provided with second fastening means suitable for adjusting the configuration of the seat in which the elbow protective elements are housed, so as to adjust the positioning of said elbow protective elements.

Hereafter the operation of the length adjustment device of the garment 10 will be described.

Reference will now be made in detail to the preferred embodiment of the invention. As above described, in the preferred embodiment the garment 10 comprises solely a pair of trousers 20 and the protective elements 40 are applied internally to the garment 10 in proper pockets 50 fixed to the internal layer of the garment 10.

It is assumed that the fixing means 60 of the garment 10 comprise two fixing members 62*a*, 62*b* defining two height positions $h_1$ and $h_2$ respectively, with reference to the belt line of the garment 10.

The fastening means 80 in their turn comprise three fastening members 82*a*, 82*b*, 82*c* defining three height positions W, $W+\Delta W_1$, $W+\Delta W_2$ respectively, with reference to the belt line of the garment 10.

By describing the functioning of the present invention, reference will be made to only one leg of the trousers 20, since the adjustment of the other leg can be performed in the same way.

When the user wears the trousers 20 can check whether the trousers length L (calculated with reference to the belt line of the garment, see FIGS. 1-4) properly fits his build.

According to what it has been previously stated, if the user feels that the trousers 20 are too short, he can adjust the trousers length L according to the invention by using the adjusting insert 70.

A first adjustment option envisages for the user the possibility to connect the fixing means 72 of the adjusting insert 70 to the fixing members 62*a* of the trousers 20 (see FIG. 9).

In this way, the length of the trousers is increased of an amount referenced by $\Delta L_1$ in FIG. 9.

Such amount $\Delta L_1$ corresponds to the portion of the adjusting insert 70 which protrudes from the bottom edge 22 of the trousers 20 once the fixing means 72 of the adjusting insert 70 have been connected to the fixing members 62*a* of the trousers 20.

As it has been previously stated, due to the simple and reliable structure of both fixing member 62*a*, 62*b* and fixing means 72, the junction between the adjusting insert 70 and the trousers 20 is very simple and it can be carried out by the user in a very short time.

If, after having performed such first adjustment, the user feels that the trousers length $L+\Delta L_1$ is still not proper according to his own needs, he has the opportunity, according to the present invention, to carry out a second adjustment.

As a matter of fact, he can detach from each other the adjusting insert 70 and the trousers 20 (so as to restore the original length L of the trousers 20) and he can connect the fixing means 72 of the adjusting insert 70 to the fixing member 62*b* of the trousers 20.

Similarly to what it has been previously described, in this way the original length L of the trousers 20 is increased of an amount referenced by $\Delta L_2$ in FIG. 10. Such amount $\Delta L_2$ corresponds to the portion of the adjusting insert 70 which protrudes from the bottom edge 22 of the trousers once the fixing member 72 of adjusting insert 70 has been connected to the fixing members 62*b* of the trousers 20*a*. Obviously since the height position $h_2$ of the fixing means 62*b* is greater than the height position $h_1$ of the fixing means 62*a*, the original trousers length L will be extended of an amount $\Delta L_2$ greater than that obtained by means of the previous adjustment (amount $\Delta L_1$).

After having set the proper adjustment of the trousers length, if the adjusting insert 70 is provided along its side edges with closing means 74, the user has also the opportunity to block the side edges of the adjusting insert 70 to each other by acting on the closing means 74. In this way, as it has been already mentioned, it is guaranteed that the side edges of the adjusting insert 70 substantially follow the outline of the trousers 20.

It should be noted that the garment 10 of the present invention can comprise more than one couple of adjusting inserts 70, each of them having a different height K. In this way the user is allowed to perform a wider range of adjustments.

Nevertheless, for assuring a correct fitting of the garment 10 on the motorcyclist's body, it is also needed that the protective elements 40 of the garment 10 are correctly positioned over the body's portion to be protected.

According to the present invention, the user can act on the fastening means 80 provided at the knee portion of the trousers for adjusting the positioning of the protective elements 40 of the garment 10.

For sake of clarity, it is assumed that the edges 56 which define the opening 52 of the pocket 50, when the protective element 40 is housed therein, are originally closed by the fastener member 82*a* which defines the height position referenced by W in FIGS. 5 and 11.

In this case it can also be assumed that the bottom edge of the protective element 40 is positioned at the same height position of the fastener member 82*a*.

According to what it has been previously stated, if the user feels that the protective element 40 is not properly positioned over its knee, he can adjust the positioning of the protective element 40 according to the invention by acting on the fastening means 80.

A first adjustment option envisages for the wearer the possibility to release the fastener member 82*a* and to close the fastener member 82*b* which defines the height position referenced by $W+\Delta W_1$ in FIGS. 6 and 12.

In this manner, the protective element 40 can be displaced down (see the arrow $F_2$ of FIG. 1 and FIGS. 6 and 12), by passing through the fastening member 82*a*, until its bottom edge encounters the fastening member 82*b*.

In this way, the protective element 40 has been displaced, with reference to its original position, by the amount referenced by $\Delta W_1$ in FIGS. 6 and 12. Such amount $\Delta W_1$ corresponds to the difference between the height positions W and $W+\Delta W_1$ of the fastening member 82*a* and 82*b*, respectively.

As it has been previously stated, due to the simple and reliable structure of the fastening member 80, the adjusting of the configuration of the pocket 50, and the related displacement of the protective element 40, is very simple and it can be carried out by the user in a very short time.

If, after having performed such first pocket adjustment, the wearer feels that the protective element 40 is still not properly positioned over his knee, he has the opportunity, according to the present invention, to carry out a second pocket adjustment.

As a matter of fact, he can release the fastener member 82*b* and close the fastener member 82*c* which defines the height position referenced by $W+\Delta W_1$ in FIGS. 7 and 13.

In this manner, the protective element 40 can be further displaced down, by passing through the fastening member 82*b*, until its bottom edge encounters the fastening member 82*c*.

In this way, the protective element 40 has been displaced, with reference to its original position, by the amount referenced by $\Delta W_2$ in FIGS. 6 and 12. Such amount $\Delta W_2$ corresponds to the difference between the height positions W and $W+\Delta W_2$ of the fastening member 82*a* and 82*c*, respectively.

As it can be easily appreciated the provision, at the bottom portion of the trousers 20, of the fixing means 60, suitable for cooperating with the fixing means 72 of the adjusting insert 70, and the arrangement of the fastening means 80, suitable for adjusting the configuration of the seat 50 in which the protective element 40 is housed, allows the user to configure the trousers 20 in different ways.

As a matter of fact, in the above described embodiment, the user can select the best adjustment among nine different configurations.

Figure 2:
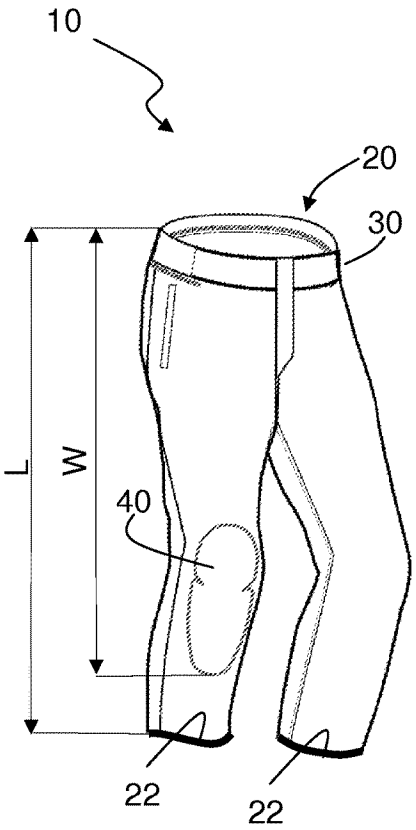
FIG. 2 shows a simplified perspective view of a first possible configuration of the garment according to the invention.
Figure 3:
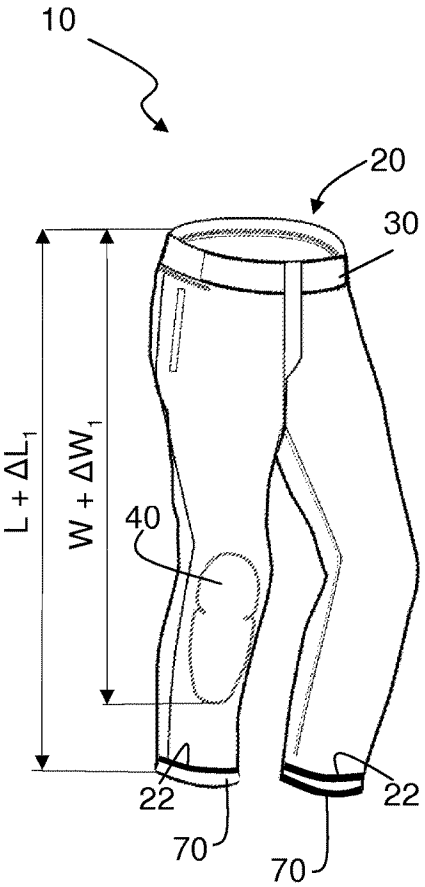
FIG. 3 shows a simplified perspective view of a second possible configuration of the garment according to the invention.
Figure 4:
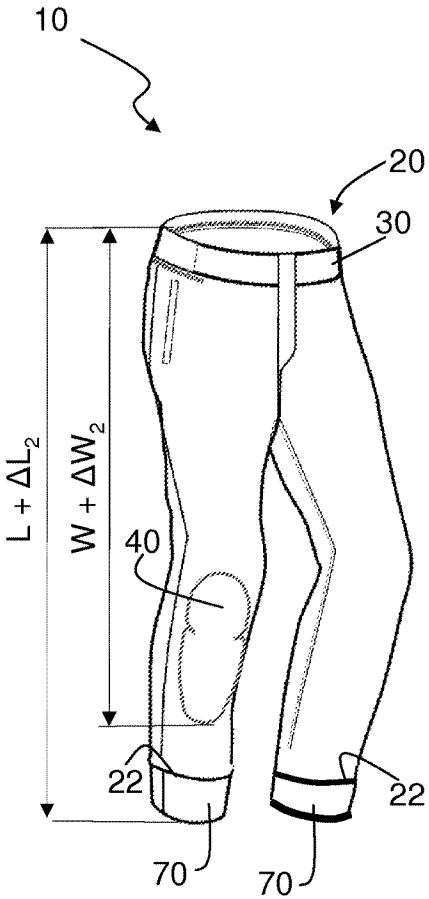
FIG. 4 shows a simplified perspective view of a third possible configuration of the garment according to the invention.

In this connection, in FIGS. 2-4 three different configurations of the garment are shown: the original configuration (FIG. 2), i.e. without the adjusting insert 70; the configuration in which the adjusting insert 70 has been fixed to the fixing elements 62*a* and the edges 56 of the opening 52 of the pocket 50 has been closed by means of the fastening members 82*b* (FIG. 3); the configuration in which the adjusting insert 70 has been fixed to the fixing elements 62*b* and the edges 56 of the opening 52 of the pocket 50 has been closed by means of the fastening members 82*c* (FIG. 4).

Moreover, it should be noted that the provision of the fastening means 80 and the possibility to displace, within certain limits, the protective elements 40 do not affect the level of safety offered by the garment.

As a matter of fact, after having adjusted the configuration of the seat 50 in which the protective element is housed, the protective element remains stable in its seat, by assuring in this way a proper protection to the underlying body portion.

Finally it should be pointed out that, in a manner obvious for a skilled man, by means of the present invention it is also possible to reduce the length of the trousers by simply detaching the adjusting insert 70 from the trousers 20 or by fixing the fixing means 72 of the adjusting insert 70 to fixing means 60 of the trousers 20 having a lower height position.

In the same manner, it is also possible to adjust the protective element 40 in a higher height position by simply closing the edges 56 of the opening 52 of the pocket 50 by means of fastening means 80 having a lower height position.

From the above description it is clear that the garment according to the present invention has characteristics suitable to advantageously solve the problems and drawbacks set out in the prior art. In particular, by using the trousers leg adjustment device above described, it is possible for the user to adjust the garment according his own needs.

The present invention has been described with reference to a preferred embodiment, but mechanically equivalent solutions are foreseeable falling within the scope of the following claims.

The invention claimed is:

1. A garment for motorcyclists comprising:

a pair of trousers having a belt portion;

at least one protective element positioned at a knee portion of at least one leg of the trousers, said at least one protective element being removably housed in a pocket defined between a flap and an interior surface of the at least one trousers leg at the knee portion, the pocket defining an opening between the flap and the interior surface through which said at least one protective element is insertable within and removable from the pocket;

means for fixing provided at a bottom portion of said pair of trousers, said fixing means being suitable for defining a plurality of height positions for said bottom portion with reference to the belt portion of the trousers; and means for fastening provided on the pocket and adapted for a wearer of the trousers for positioning of said at least one protective element in said pocket;

wherein the fastening means comprise a plurality of separate fastening member pairings in proximity of the opening of the pocket, each of said fastening member pairings provided on the pocket at a distinct height position with reference to the belt portion and comprising first and second mating portions suitable for closing the opening of the pocket;

wherein one of the fastening member pairings selectively defines a floor for the pocket; and wherein each trousers leg comprises one said pocket in which one of said at least one protective element is removably housed.

2. The garment of claim 1, further comprising at least one adjusting insert usable with the fixing means in order to adjust a length of said pair of trousers.

3. The garment according to claim 2, wherein the fixing means comprise zip fasteners, hook-and-loop fasteners or snap fasteners.

4. The garment according to claim 2, wherein a top edge of the adjusting insert is provided with means for fixing suitable for cooperating with the fixing means arranged at the bottom portion of the trousers.

5. The garment according to claim 2, wherein the adjusting insert is shaped as a rectangular flexible panel having height and length;

the length of the adjusting insert coinciding with a bottom perimeter of each trousers leg.

6. The garment according to claim 1, wherein the fastening means are hook-and-loop fasteners or snap fasteners or zip fasteners.

7. The garment according to claim 1, wherein for each of the fastener member pairings for said pocket of each trousers leg, a depth for each said pocket is definable via closure of corresponding of the first and second mating portions, whereby the floor for each said pocket is correspondingly defined for positioning said one protective element in each of said pocket.

8. The garment according to claim 7, wherein each said pocket is configured to retain said one protective element during adjustment of said one protective element relative to the fastening member pairings of said pocket.

9. The garment according to claim 2, wherein the fixing means comprise a plurality of fixing elements, said fixing elements running along an internal perimeter of each trousers leg of the garment so as to define a junction line between the trousers and the adjusting insert, the junction line having a substantially loop shape.

10. A garment for motorcyclists comprising:

a pair of trousers having a belt portion;

a pocket arranged within an interior of at least one leg of the trousers at a knee portion, the pocket having one side defined by an interior surface of the at least one trousers leg and forming an opening through which a protective element is insertable within and removable from the pocket;

means for fixing provided at a bottom portion of said pair of trousers, said fixing means being suitable for defining a plurality of height positions for said bottom portion with reference to the belt portion of the trousers; and means for fastening provided on the pocket;

wherein the fastening means comprise a plurality of separate fastening member pairings in proximity of the opening of the pocket, each of said fastening member pairings provided on the pocket at a distinct height position with reference to the belt portion and comprising first and second mating portions suitable for closing the opening of the pocket;

wherein one of the fastening member pairings selectively defines a floor for the pocket; and wherein each trousers leg comprises one said pocket.

11. The garment according to claim 10, wherein the opening is oriented toward a bottom portion of said trousers.

12. The garment according to claim 10, further comprising a protective element removably housed in the pocket, wherein for each of the fastening member pairings, a depth for the pocket is defined via closure of the first and second mating portions, whereby the floor is correspondingly defined for positioning of said protective element in said pocket.

13. The garment of claim 12, wherein the pocket is configured to retain said protective element during adjustment of the protective element relative to the fastening member pairings.

14. The garment of claim 10, further comprising at least one adjusting insert usable with the fixing means in order to adjust the length of said pair of trousers.

15. A garment for motorcyclists comprising:

a pair of trousers having a belt portion;

at least one protective element positioned at a knee portion of at least one leg of the trousers, said at least one protective element being removably housed in a pocket arranged within an interior of the at least one trousers leg at the knee portion, the pocket having an opening through which said at least one protective element is insertable within and removable from the pocket; and means for fastening provided on the pocket and adapted for a wearer of the trousers for positioning of said at least one protective element in said pocket;

wherein the fastening means comprise a plurality of separate fastening member pairings in proximity of the opening of the pocket, each of said fastening member pairings provided on the pocket at a distinct height position with reference to the belt portion and comprising first and second mating portions suitable for closing the opening of the pocket;

wherein one of the fastening member pairings selectively defines a floor for the pocket; and wherein each trousers leg comprises one said pocket.

16. The garment according to claim 15, wherein for the fastening member pairings for each pocket, a depth for the pocket is defined via closure of the first and second mating portions, whereby the floor is correspondingly defined for positioning of said at least one protective element in the pocket.

17. The garment of claim 15, further comprising means for fixing provided at a bottom portion of said pair of trousers, said fixing means suitable for defining a plurality of height positions for said bottom portion with reference to the belt portion of the trousers, wherein the plurality of height positions for said bottom portion correspond to the plurality of fastening members for the pocket.

18. The garment of claim 1, wherein for each pocket the first mating portions for the fastening member pairings are correspondingly provided on the flap and the second mating portions for each of the fastening member pairings are correspondingly provided on the interior surface.

19. The garment of claim 15, wherein each pocket has one side defined by an interior surface of the corresponding trousers leg at the knee portion.

20. The garment of claim 19, wherein each pocket is defined between a flap and the interior surface of the corresponding trousers leg at the knee portion, and wherein the opening of each pocket is defined between the flap and the interior surface of the corresponding trousers leg at the knee portion.

* * * * *